US008191606B2

(12) United States Patent
Edlin

(10) Patent No.: US 8,191,606 B2
(45) Date of Patent: Jun. 5, 2012

(54) SECURITY SCREEN SYSTEM

(75) Inventor: Craig Andrew Edlin, Chiang Mai (TH)

(73) Assignee: Meshtec International Co., Ltd., Chiang Mai (TH)

( * ) Notice: Subject to any disclaimer, the term of this patent is extended or adjusted under 35 U.S.C. 154(b) by 172 days.

(21) Appl. No.: 12/304,144

(22) PCT Filed: Jul. 11, 2007

(86) PCT No.: PCT/AU2007/000964

§ 371 (c)(1),
(2), (4) Date: Dec. 10, 2008

(87) PCT Pub. No.: WO2008/006160

PCT Pub. Date: Jan. 17, 2008

(65) Prior Publication Data

US 2009/0199983 A1 Aug. 13, 2009

(30) Foreign Application Priority Data

Jul. 11, 2006 (AU) ..... 2006903721

(51) Int. Cl.
*A47G 5/00* (2006.01)

(52) U.S. Cl. ..... 160/378; 160/328

(58) Field of Classification Search ..... 160/374.1, 160/369, 392, 395, 328, 372, 373, 374, 371, 160/378

See application file for complete search history.

(56) References Cited

U.S. PATENT DOCUMENTS

| | | | | | |
|---|---|---|---|---|---|
| 1,897,418 | A * | 2/1933 | Carlson | 160/397 |
| 2,197,489 | A * | 4/1940 | Trulock | 160/378 |
| 2,233,412 | A * | 3/1941 | Hill | 160/378 |
| 2,246,995 | A * | 6/1941 | Ingersoll et al. | 160/378 |
| 2,255,581 | A * | 9/1941 | Ewing | 160/392 |
| 2,335,361 | A * | 11/1943 | Schiller | 160/395 |
| 2,417,711 | A * | 3/1947 | Smith et al. | 160/353 |
| 2,498,716 | A * | 2/1950 | Seide | 160/378 |
| 2,894,579 | A * | 7/1959 | Rust et al. | 160/378 |
| 3,788,216 | A * | 1/1974 | Lambert | 101/127.1 |
| 4,232,310 | A * | 11/1980 | Wilson | 340/550 |
| 4,932,457 | A | 6/1990 | Duncan | |
| 5,141,046 | A | 8/1992 | Duncan | |
| 6,057,029 | A | 5/2000 | Demestre et al. | |
| 6,802,357 | B2 * | 10/2004 | Taylor et al. | 160/371 |
| 7,810,545 | B2 * | 10/2010 | Bernardi | 160/328 |

FOREIGN PATENT DOCUMENTS

| | | |
|---|---|---|
| EP | 1433919 A2 | 6/2004 |
| GB | 2263927 A | 8/1993 |
| JP | 1068279 A | 3/1998 |
| WO | 9914550 A1 | 3/1999 |

* cited by examiner

*Primary Examiner* — David Purol
(74) *Attorney, Agent, or Firm* — Ronald E. Greigg

(57) ABSTRACT

A screen system in which a mesh is connected to a frame through a tensioning system. The tensioning system includes a plurality of holders which are fastened to edge portions of the mesh and a plurality of adjustable tensioners which connect the holders to the frame. Tension in the mesh and the frame can thereby be adjusted after the screen has been assembled.

20 Claims, 8 Drawing Sheets

SECURITY SCREEN SYSTEM

FIELD OF THE INVENTION

This invention relates to screen systems, and particularly but not only to security screens in which a mesh is held in a frame to form a closure for an aperture such as a door or window.

BACKGROUND TO THE INVENTION

A wide range of security screen systems are available for doors and windows. These systems typically attempt to secure a mesh within a frame by using conventional fasteners such as rivets, screws or glue, by using wedges, or by sing a deformation of the edges of the mesh.

A common screen system attaches the mesh to the frame by a simple fastener. Generally the mesh is attached to the outside wall of a frame with a screw, rivet or glue. However, the fasteners are vulnerable when the mesh is impacted or when an attempt is made to pry the mesh from the frame. The mesh is also semi rigid and may appear floppy. As the mesh is not taut it can extend or bulge outside of the perimeter of the frame. This can interfere with the normal operation of the product. For example, the mesh in a sliding door can rub or grind against the mullion of the glass door that is adjacent to it.

Fabrication of the product can also be difficult and time consuming because the mesh must be balanced in place during attachment of the fasteners to the frame. The mesh cannot sit flat on an assembly bench. The fabricator usually places packing under the mesh so that it sits in the final position and places weights on top of the mesh to attempt to keep the mesh flat. Once the mesh is fastened to the frame there is no possibility of tensioning the mesh. If glue is used, then the product must remain stationary until the glue sets. The fasteners grip only a very small edge of the mesh. This means that if the mesh is cut slightly too small, the retention of the mesh is weakened considerably as the fasteners will be too close to the edge of the mesh or, if glue is used, will not sufficiently cover enough surface area on the mesh. If the mesh is cut slightly too large, then the mesh will be unavoidably floppy.

Another common screen system involves a frame which has a channel section to receive the mesh. The mesh is placed into the channel of the frame and wedges are forced between one or both of the channel walls and the mesh. The wedges are typically made from a soft material such as PVC A similar principle uses a spline to retain a flyscreen in a frame channel.

These products overcame some of the weaknesses of the products that relied on fastening the mesh directly to the frame. Aesthetic appearance improved (because of the absence of unsightly fasteners), fabrication became easier (as the need to hold the mesh into a fixed position was removed) and the insertion of wedges allowed some tensioning of the mesh.

However, the flatness or tautness of the mesh could not be assured. The fabricator could not control the amount of tension on the mesh as the wedges were forced into position in the frame channel. Mesh is semi rigid and not uniform or consistent, and could have small waves of stress points. Without being able to control the tensioning of the mesh the inconsistency of the flat surface of the mesh often remained after inserting the wedges. For example, once the wedges were inserted into position into one channel of one frame there would be immediate stress on the mesh. It would be common to form stress diagonally, etc across the mesh. This often resulted in bubbles or waves in the mesh. If the mesh was cut too short the mesh would not be sufficiently retained in the channel.

If the mesh was cut too long, it would result in a floppy screen. This method also meant that the product could not be unassembled or adjusted. If the screen was made to the incorrect size, the product could not be unassembled and the components reused without significant damage.

Retention of the mesh to the frame is also weak when wedges are used. The wedge material relies on pressure or friction to retain the mesh to the frame. Due to the soft nature of the wedge materials the wedge could easily loose its grip on the mesh and release the mesh on impact. The assembly also relied on the strength of the channel wall which was an aluminum extrusion. Due to the low strength of aluminum, the channel walls are also prone to splay or spread apart on impact of the mesh and consequently loosen the grip on the mesh. The wedges sometimes pull out of the channel and the mesh can slip past the wedges.

Another screen system deforms the edge of the mesh and engages the edge with a corresponding portion of the frame. Typically the edge of the mesh is bent to form an angle or hook. This angle or hook is forced into the frames channel. Inside the frame channel is a tooth or some type of edge to engage the hooked portion of the mesh. Sometimes rather than engaging one wall of the channel a wedge is forced into the frames channel between one channel wall and the straight portion of the mesh so that the wedge rests over the top of the hook or bent portion of the mesh.

The impact strength of these screens is weaker than conventional fasteners. They are difficult to accurately fabricate as they rely on both perfectly cutting the mesh and bending the edge of the mesh. They cannot be adjusted for tension. Undercut mesh is impossible to correctly engage in the channel. Overcut mesh is floppy. In addition these systems rely on additional machinery such as a press brake to bend the edge of the mesh. This machinery is relatively expensive.

These products also have a corrosion potential as the mesh is typically stainless steel and it rests in an aluminum frame channel. The channel can easily retain water which can set off galvanic corrosion between the stainless steel mesh and the aluminum channel.

SUMMARY OF THE INVENTION

It is an objet of the invention to provide an improved screen system, or at least to provide an alternative to existing systems.

In one aspect the invention resides in a screen system including: a mesh, a frame having side members which surround the mesh, a plurality of holders which are fastened to edge portions of the mesh, and a plurality of adjustable tensioners which connect the holders to the frame.

Preferably the tensioners are individually adjustable to increase or decrease local tension in the mesh and/or the frame. The tensioners may also be adjusted to alter the shape of frame.

Preferably the side members contain the holders and the tensioners. Each holder includes a portion which contacts the mesh and is integral with a portion which provides engagement for the tensioners.

Preferably the holders are strips which extend inside opposite sides of the frame. Each tensioner is preferably a screw or a nut and bolt combination.

In one embodiment the frame includes side members having an outer portion which provides manual access to the tensioners. In another embodiment the frame includes side members having an inner portion which provides manual access to the tensioners. Removable seals or covers are generally provided to conceal the holders and/or tensioners within the frame.

In a further aspect the invention resides in a method of forming a screen, including: fastening the edges of mesh to respective holders, locating the holders within side members of a frame, connecting the holders to the frame using a plurality of tensioners, constructing the Same by joining the side portions, and adjusting the tensioners to tighten the mesh within the frame.

Preferably the tensioners are screws, or nut and bolt combinations. The tensioners may be adjusted by access through an inner or an outer part of the frame.

The invention also resides any alternative combination of parts which are indicated in this specification. All equivalents of these parts are deemed to be included whether or not explicitly set out.

LIST OF FIGURES

Preferred embodiments of the invention will be described with respect to the drawings, of which:

Figure 3:
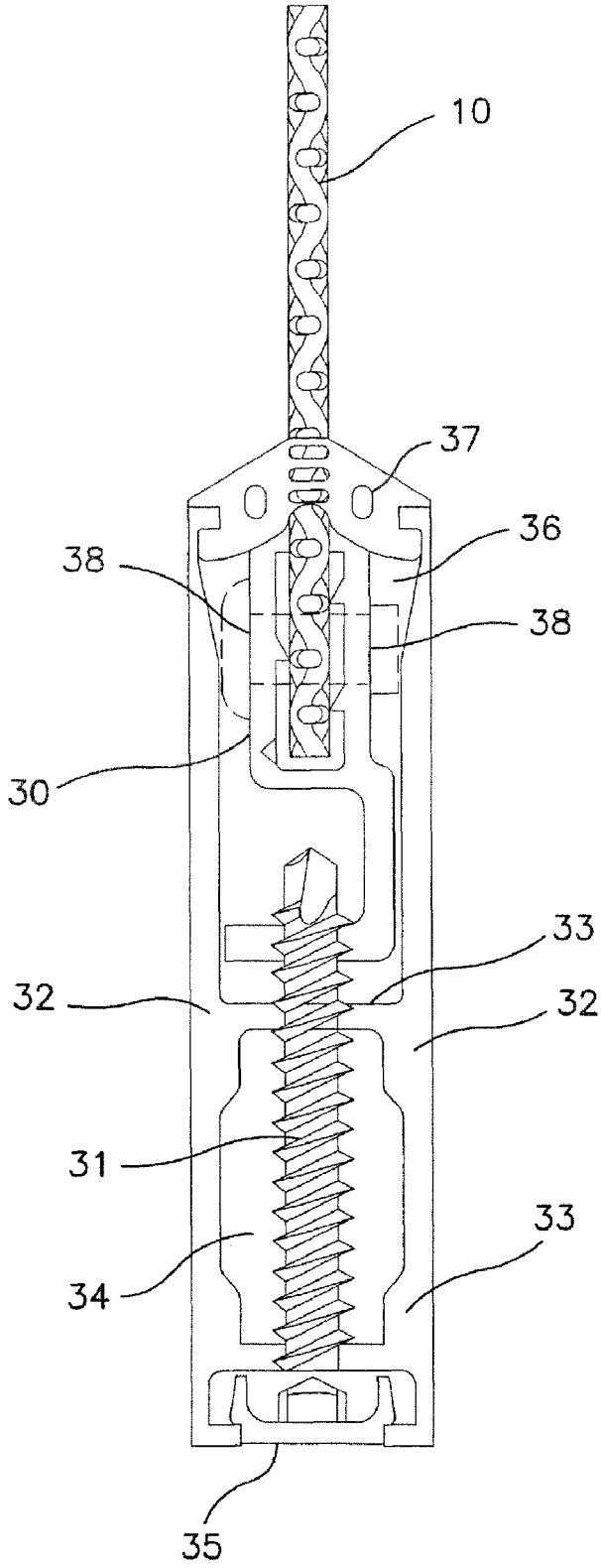
FIG. 3 shows an alternative connection between the mesh and the frame.
Figure 4A:
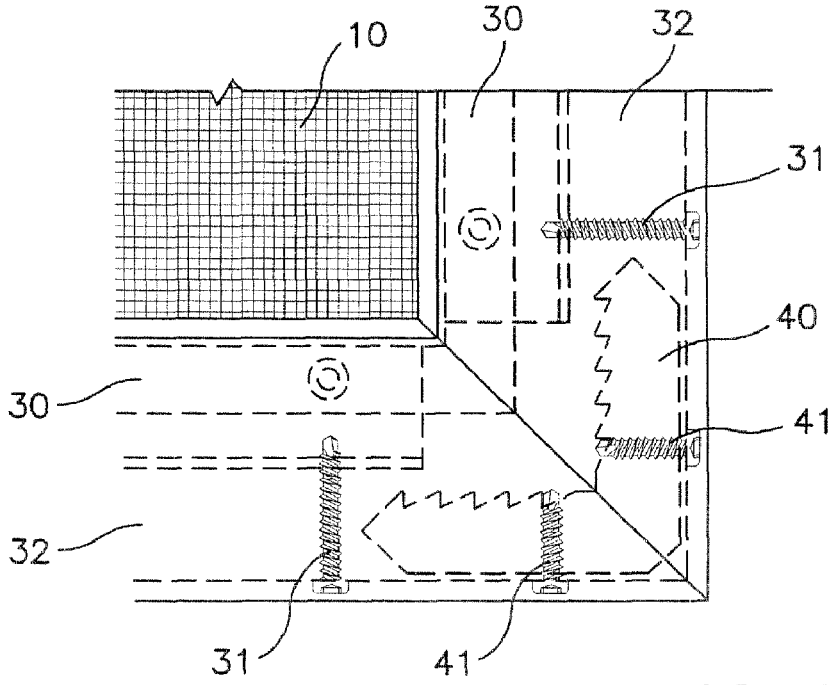
Figure 4B:
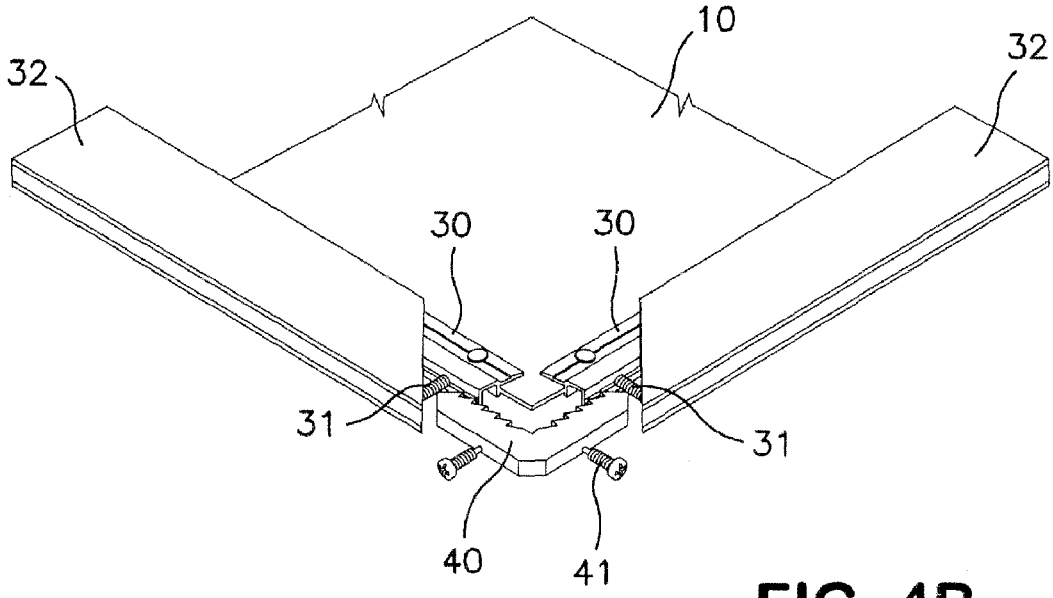
Figure 5:
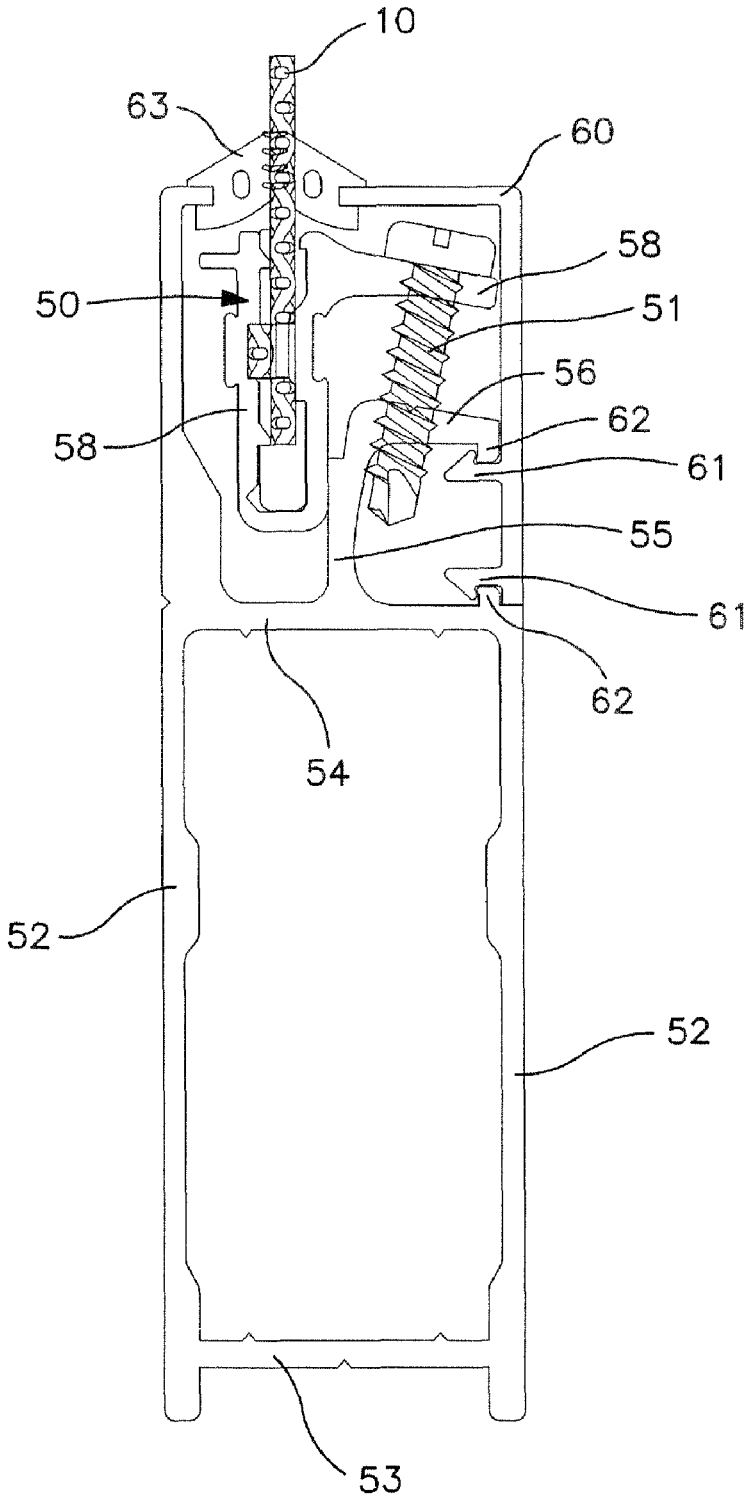
Figure 6A:
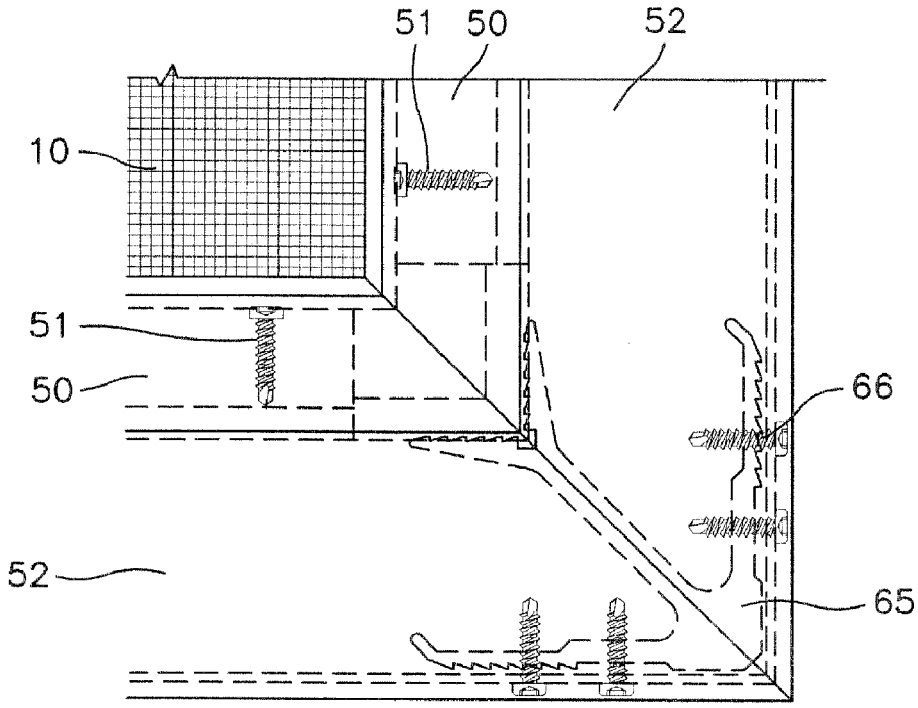
Figure 6B:
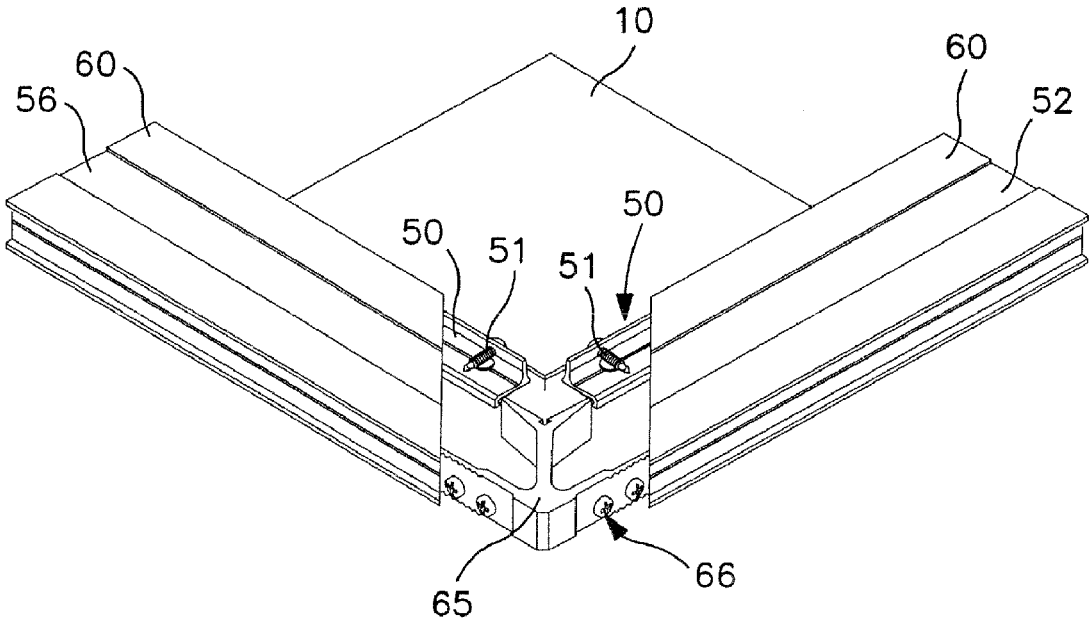
Figure 7:
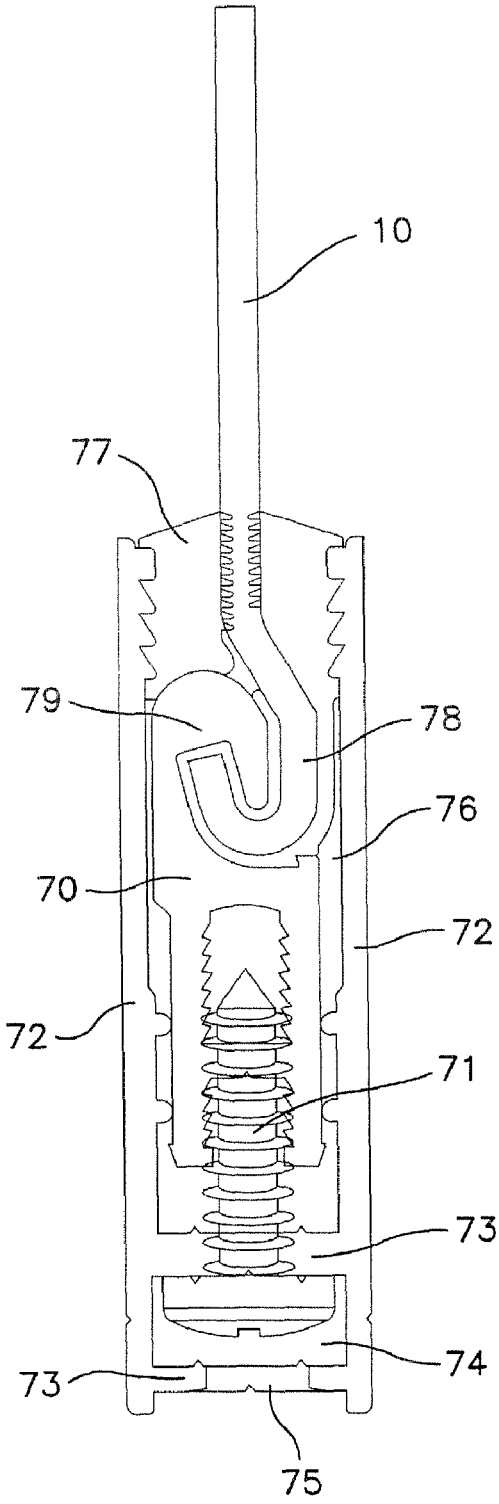
Figure 8:
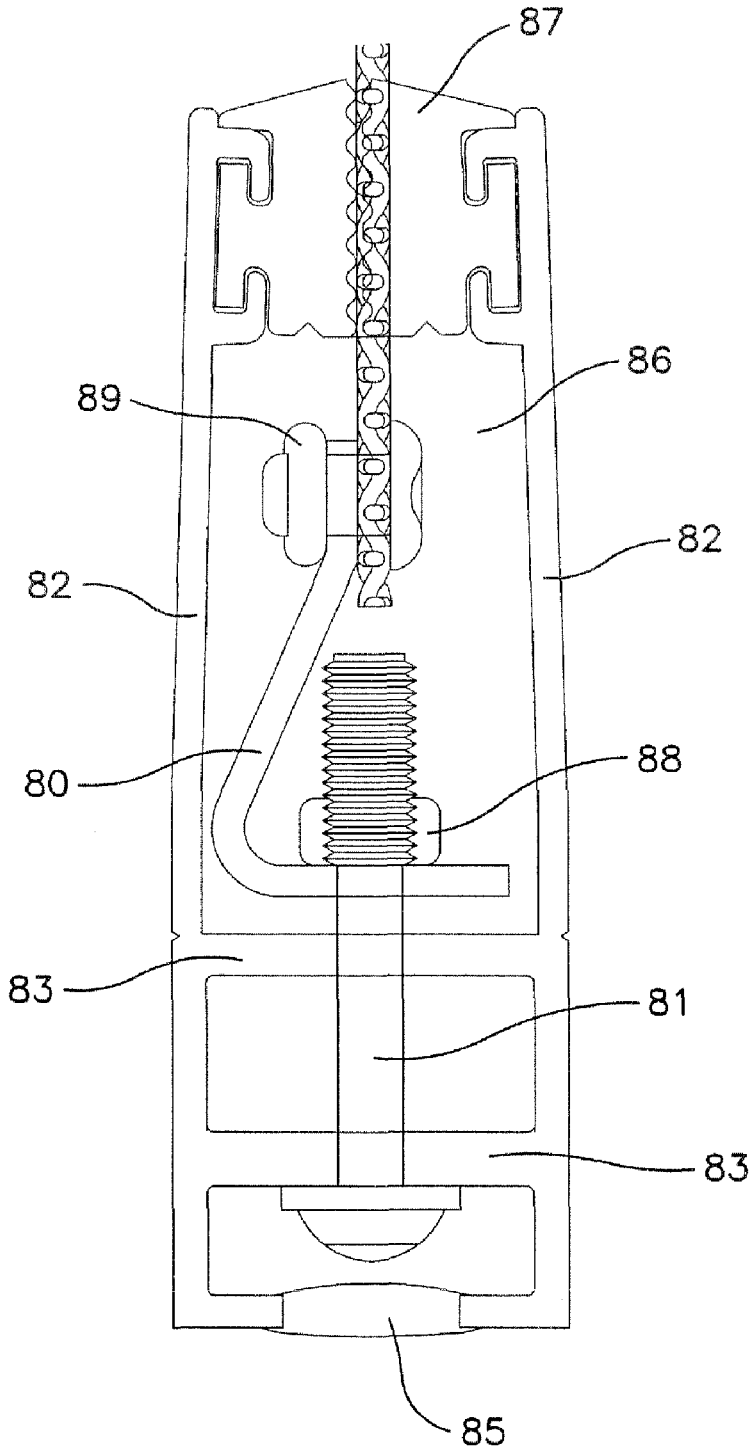

FIGS. 4*a* and 4*b* show corner detail for the connection in FIG. 3, FIG. 5 shows a further connection between the mesh and the frame, FIGS. 6*a* and 6*b* show corner detail for the connection in FIG. 5, FIG. 7 shows a further connection between the mesh and the frame, and FIG. 8 shows a further connection between the mesh and the frame.

DESCRIPTION OF PREFERRED EMBODIMENTS

Referring to these drawings it will be appreciated that the invention can be implemented in a range of different ways for a range of different screen systems. These embodiments are given by way of example only.

Figure 1:
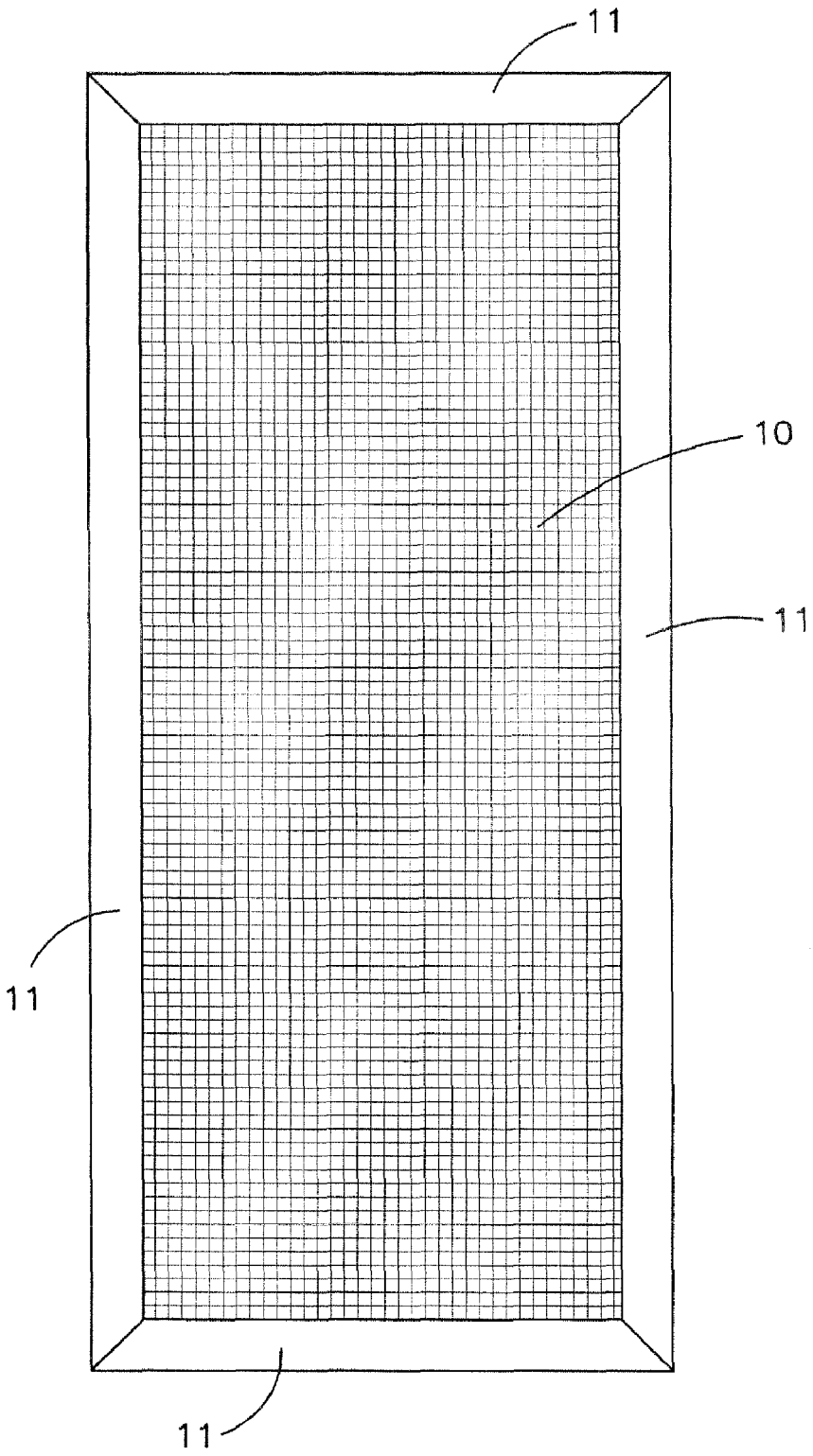
FIG. 1 shows a screen assembly having a mesh and a frame.

FIG. 1 shows a simplified screen for a door or window, having a rectangular assembly with a mesh 10 and a frame formed by four side members 11. The term mesh refers to any infill material such as woven stainless steel wire, a perforated metal sheet, insect resistant fabric and so on. The side members are typically aluminum channels with a variety of internal structures. The edges of the mesh are fastened within the side members which are in turn joined at the corners of the frame. The mesh and frame can be tensioned by a tensioning system (not shown) which is located within the side members. Unwanted distortions of the mesh can be reduced by local adjustments of a series of tensioner components. Similarly the frame can be slightly distorted if necessary to fit a particular aperture. There are many possible configurations of the frame, the mesh and the tensioners for particular circumstances.

Figure 2:
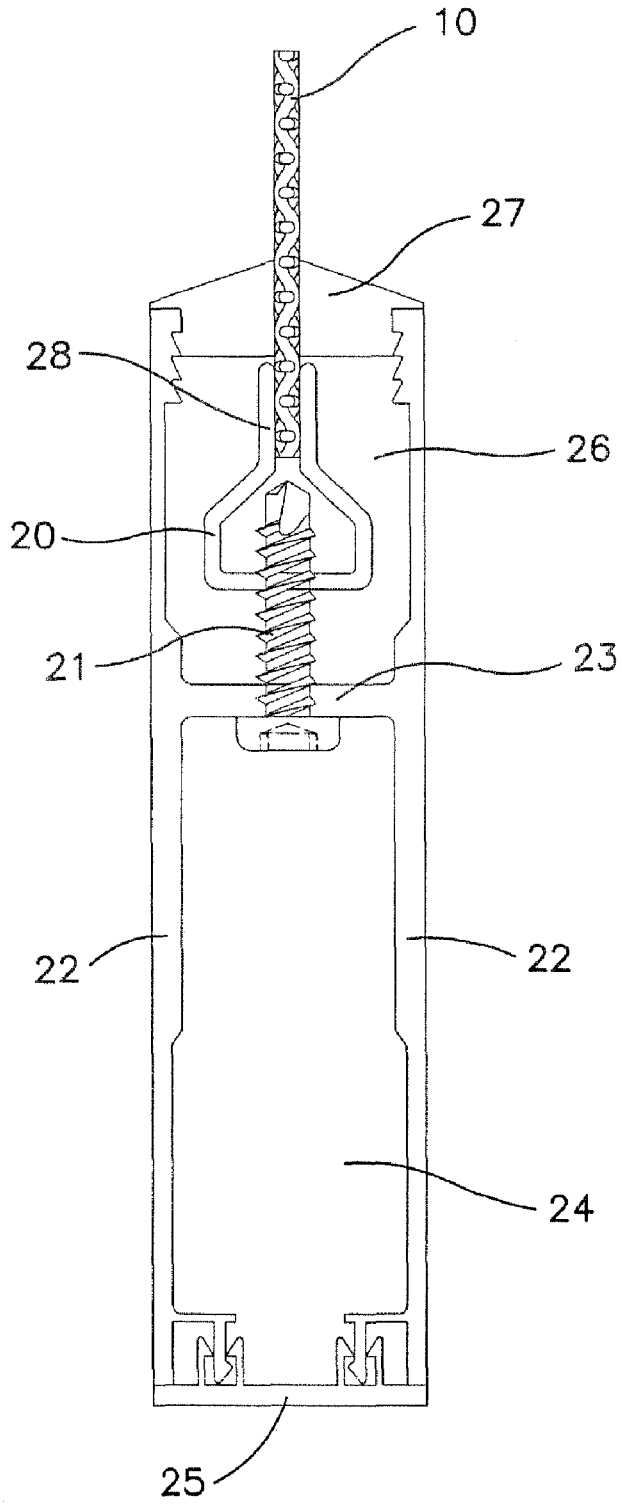
FIG. 2 shows an adjustable connection between the mesh and the frame.

FIG. 2 shows a connection between the mesh 10 and a side member of the frame in FIG. 1, using a holder 20 and a tensioner 21. In this example the side member has an H-shaped section with parallel side walls 22 and a web 23 which joins the walls. An outer channel 24 is closed by a removeable seal 25. An inner channel 26 is closed by a two part seal 27 which contacts the mesh 10 and prevents inflow of water. The holder 20 serves as a link between the mesh and the tensioner 21 while the tensioner provides a hn between the holder and the frame. They provide an adjustable feature of the screen with many possible configurations. The holder and/or the tensioner are generally separate components but could also be integrated.

The holder 20 in FIG. 2 is a strip or possibly a series of strips, having an approximately C-shaped section, which runs along the edge of the mesh and is located in channel 26 of the frame member. The tensioner 21 is a screw which forms one of a series of screws along the edge of the mesh. The head of the screw engages web 23 of the frame member while the body of the screw engages the holder. This holder has a body with two opposed flat portions or lips 28 which are typically glued, riveted, crimped or otherwise fastened to the mesh 10. The holder retains part of the tensioner. In is case a thread on the body of the holder engages a thread the body of the screw, typically a self tapping screw. Turning the screw changes the position of the holder in channel 26 and therefore tightens or loosens the mesh against the frame as required.

FIG. 3 shows an alternative connection between the mesh 10 and a side member of the frame in FIG. 1, using a holder 30 and a tensioner 31. In this example the side member has a channel section with parallel side walls 32 and a pair of webs 33 which join the walls. An outer channel 34 is closed by a part seal 35. An inner channel 36 is closed by a two pad seal 37 which contacts the mesh 10. As before, the holder 30 is a strip or series of strips along the edge of the mesh while the tensioner is one of a series of screws, all located inside the side member. The head of the screw engages the outer web 33 of the frame member while the body of the screw engages a portion of the holder. The holder has a body with two opposed flat portions 38 which are fastened to the mesh 10. A number of fastening teeth and a rivet are indicated by way of example. A head on the body of the holder engages a thread the body of the screw. Local tension in the mesh and the frame can be adjusted by tightening or loosening the screw.

FIGS. 4*a* and 4*b* show a corner of the screen in FIG. 1 in relation to the connection shown in FIG. 3. The corner is formed by two side members held together by a bracket 40 and screws 41. The bracket is typically either pressed metal or an aluminium extrusion. Two holders 30 in strip form are fastened to the edges of the mesh 10 and enclosed by the side members. Respective tensioner screws 31 are shown connecting the holders to die side members. A series of tensioners are provided at a suitable spacing (not shown) along each side member towards the neighbouring corners. The tensioners are individually adjustable to increase or decrease local tension in the mesh, or possibly to alter the local shape of the frame if required in particular circumstances.

FIG. 5 shows a her alternative connection between the mesh 10 and a side member of the frame in FIG. 1, using a holder 50 and a tensioner 51. In this example the side member has a more complex channel section with side walls 52 joined by webs 53 and 54. An extension of web 54 includes a post 55 and a flange 56. The holder 50 is formed by an approximately C-shaped strip having two opposed portions 58 which are crimped or otherwise fastened to the mesh in a suitable manner. A flange 57 extends from the holder to provide an attachment for a screw which forms the tensioner. The head of the screw engages flange 57 while the body of the screw engages flange 56. The holder is contacted and steadied by post 55 as the screw is tightened to provide tension in the mesh. Cover 60 has a pair of lips 61 which engage corresponding lips 62 on flange 56 and web 54. A two part seal 63 closes the side member and contacts the mesh.

FIGS. 6*a* and 6*b* show a corner of the screen in FIG. 1 in relation to the connection shown in FIG. 5. The corner is formed by two side members held together by a bracket 65 and screws 66. The bracket is typically either pressed metal or an aluminium extrusion which fits between webs 53 and 54, Two holders 50 in strip form are fastened to the edges of the mesh 10 and enclosed by the side members. Respective tensioner screws 51 are shown connecting the holders to the side members. A series of tensioners are provided at a suitable spacing (not shown) along each side member towards the neighbouring corners. As before, the tensioners are individually adjustable to increase or decrease local tension in the mesh and/or the frame.

The tensioners in FIGS. 2, 3 and 4 are aligned approximately in the plane of the mesh and are oriented outwards with respect to the side member. Adjustments of the tensioners along the side member of the frame in FIG. 1 are made through the outside of the frame and must generally be made before the frame is installed in an aperture. The tensioners in FIGS. 5 and 6 are adjacent the plane of the mesh and are oriented inwards with respect to the side member. Adjustments can therefore be made both before and after the frame is installed. In both cases the tensioning system is contained by die frame and is not accessible from outside the screen. These alternatives provide screen systems which both secure and aesthetic.

A screen as described above is typically assembled by first cutting the mesh to a required size for a particular purpose such as a door or window. Holders are then fastened along the edges of the mesh. A wide range of fasteners may be used. The side members are also cut to size. A set of tensioners is then used to connect the holders within the side members. The frame is constructed by joining the side members to form the corners. Brackets are inserted in the corners if required. The mesh is tensioned as required by adjusting the tensioners and the frame can then be installed in an aperture.

FIG. 7 shows a further alternative connection between the mesh 10 and a side member of the frame in FIG. 1, using a holder 70 and a tensioner 71. The side member has a channel section with parallel side wails 72 and a pair of webs 73 which join the walls. An outer channel 74 is closed by a seal 75. An inner channel 76 is closed by a two part seal 77 which steadies the mesh. The holder 70 is a strip or series of strips along the edge of the mesh while the tensioner is one of a series of screws, all located inside the side member. The head of the screw en-ages the inner web 73 of the frame member while the body of the screw engages a portion of the holder. The edge of the mesh is shaped to form a hook 78 which is retained by a slot 79 at one end of the body of the holder. An internal thread at the other end of the body of the holder engages a thread the body of the screw. Local tension in the mesh and the frame can be adjusted by tightening or loosening the screw.

FIG. 8 shows a still further alternative connection between the mesh 10 and a side member of the frame in FIG. 1, using a holder 80 and a tensioner 81. The side member has a channel section with parallel side walls 82 and a pair of webs 83 which join the walls. An outer channel 84 is closed by a seal 85. An inner channel 86 is closed by a two part seal 87 which steadies the mesh. The holder 80 is a strip or series of strips along the edge of the mesh while the tensioner 81 is one of a series of bolts with corresponding nuts 88, all located inside the side member. The head of the bolt engages an outer web 83 of the frame member while the body of the bolt and the nut engage a portion of the holder. The edge of the mesh is fastened to the holder by a series of rivets 89. Local tension in the mesh and the tame can be adjusted by tightening or loosening the bolt.

A wide range of variations for both the holders and the tensioners will be appreciated. The holders can be fastened to the mesh using a range of conventional means such as glue, rivets and/or crimping. Similarly the tensioners can be provided as screws, nut and bolt combinations, or possibly integrated with the holders.

The invention claimed is:

1. A screen system including:

a mesh, a frame having side members which surround the mesh, which side members are formed by two parallel side walls and a web joining the side walls forming an H-shaped cross section for the side members, and which side walls and web define an inner channel of each side member, a plurality of holders which are disposed in the inner channel and which are fastened to an edge portion of the two opposed lips of the holder, with the edge portion of the mesh diposed between the two opposed lips of the holder, a plurality of adjustable tensioners which connect the holders to the frame at the web of the side members, and a seal which joins the mesh to the frame and which conceals and encloses the holders within the inner channel, the seal being attached to the two parallel side walls of the side members and being disposed parallel to the web of the side members.

2. A screen system according to claim 1 wherein the tensioners are individually adjustable to increase or decrease local tension in the mesh and/or the frame.

3. A screen system according to claim 1 wherein the tensioners are individually adjustable to alter the shape of frame.

4. A screen system according to claim 1 wherein the side members contain the holders and tensioners.

5. A screen system according to claim 1 wherein each holder includes a portion which contacts the mesh and is integral with a portion which provides engagement for the tensioners.

6. A screen system according to claim 1 wherein each holder includes a pair of surfaces which contact opposite sides of the mesh.

7. A screen system according to claim 1 further including rivets, teeth, adhesive or welds which fasten the holders to the mesh.

8. A screen system according to claim 1 wherein each holder includes a portion with a plurality of apertures which retain respective tensioners.

9. A screen system according to claim 1 wherein the frame and the holders locate the tensioners outside and inline with the mesh.

10. A screen system according to claim 1 wherein the frame and the holders locate the tensioners adjacent to the mesh.

11. A screen system according to claim 1 wherein the holders are strips which extend inside opposite sides of the frame.

12. A screen system according to claim 1 wherein each tensioner is manually adjustable to pull a respective holder into the frame and thereby locally tighten the mesh.

13. A screen system according to claim 1 wherein each tensioner is a screw or a nut and bolt combination.

14. A screen system according to claim 1 wherein the side members have an outer channel which provides manual access to the tensioners.

15. A screen system according to claim 1 wherein the side members have the inner channel which provides manual access to the tensioners.

16. A screen system according to claim 1 further including a removable cover which conceals the tensioners within the frame.

17. A method of forming a screen system according to claim 1, including:

fastening the edges of the mesh to respective holders, placing the holders within the inner channel of the side members of the frame, connecting the holders to the frame using the plurality of tensioners, constructing the frame by joining the side members, and adjusting the tensioners to tighten the mesh within the frame.

18. A method according to claim 17 wherein the tensioners are screws, or nut and bolt combinations.

19. A method according to claim 17 wherein the tensioners are adjusted by access through an outer part of the frame.

20. A method according to claim 17 wherein the tensioners are adjusted by access through an inner part of the frame.

* * * * *